US011091178B2

(12) United States Patent
Zhang et al.

(10) Patent No.: US 11,091,178 B2
(45) Date of Patent: Aug. 17, 2021

(54) VEHICLE SUSPENSION SYSTEM

(71) Applicant: General Electric Company, Schenectady, NY (US)

(72) Inventors: Jingjun Zhang, Lawrence Park, PA (US); Phani Kumar Venkata Pullabhotla, Bangalore (IN); Ravikumar Dhulipalla, Bangalore (IN); Marcel Philippe Vasconcelos Silva, Pará de Minas (BR)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 263 days.

(21) Appl. No.: 16/137,192

(22) Filed: Sep. 20, 2018

(65) Prior Publication Data

US 2020/0094857 A1 Mar. 26, 2020

(51) Int. Cl.

| | |
|---|---|
| ***B61F 5/04*** | (2006.01) |
| ***B61F 3/04*** | (2006.01) |
| ***B61F 1/14*** | (2006.01) |

(52) U.S. Cl.

CPC ..... *B61F 5/04* (2013.01); *B61F 1/14* (2013.01); *B61F 3/04* (2013.01)

(58) Field of Classification Search

CPC ..... B61F 1/14; B61F 3/04; B61F 5/04; B61F 5/301; B61F 5/52; B61F 5/16; B61F 5/30; B61C 9/50; B61C 9/48

See application file for complete search history.

(56) References Cited

U.S. PATENT DOCUMENTS

| | | | | |
|---|---|---|---|---|
| 1,813,140 A * | 7/1931 | Bethel | B61C 9/50 105/139 |
| 4,167,906 A * | 9/1979 | Steinmann | B61F 3/06 105/168 |
| 4,679,506 A | 7/1987 | Goding | |

(Continued)

FOREIGN PATENT DOCUMENTS

| | | |
|---|---|---|
| DE | 3824709 A1 | 2/1989 |
| RU | 2005104373 A1 | 7/2006 |

(Continued)

OTHER PUBLICATIONS

Search Report completed Apr. 9, 2020 for corresponding Eurasian Application No. 201991947 (2 pages).

(Continued)

*Primary Examiner* — Mark T Le

(74) *Attorney, Agent, or Firm* — Philip S. Hof; The Small Patent Law Group, LLC

(57) ABSTRACT

A locomotive suspension system includes a truck frame coupled with a locomotive body frame by one or more upper suspensions and a first motor suspension coupled with a first motor and the truck frame. The first motor is coupled with a first axle of the truck frame. The locomotive suspension system also includes a second motor suspension coupled with a second motor and the truck frame. The second motor is coupled with a second axle of the truck frame. The first and second motor suspensions are asymmetrically arranged on opposite sides of a bisecting plane of a truck wheelbase of the truck frame. The truck wheelbase extends from the first axle to the second axle along a length of the truck frame.

20 Claims, 6 Drawing Sheets

(56) References Cited

U.S. PATENT DOCUMENTS

| | | | | |
|---|---|---|---|---|
| 4,679,507 | A * | 7/1987 | Rassaian | B61F 5/38 105/136 |
| 4,765,250 | A | 8/1988 | Goding | |
| 4,787,318 | A * | 11/1988 | Vogel | B61C 9/50 105/136 |
| 6,267,062 | B1 | 7/2001 | Hamilton, Jr. | |
| 6,745,700 | B2 | 6/2004 | Ma et al. | |
| 6,871,598 | B2 | 3/2005 | Schaller et al. | |
| 9,302,685 | B2 * | 4/2016 | Coding | B61F 5/08 |

FOREIGN PATENT DOCUMENTS

| | | | |
|---|---|---|---|
| RU | 2284931 | C1 | 10/2006 |
| RU | 179330 | A | 5/2018 |

OTHER PUBLICATIONS

English translated version of the Search Report dated Apr. 9, 2020 for corresponding Eurasian Application No. 201991947 (2 pages).
Office Action received for related Eurasian Patent Application No. 201991947 dated May 11, 2021 (3 pages).
English Translation of Office Action received for related Eurasian Patent Application No. 201991947 dated May 11, 2021 (3 pages).

* cited by examiner

VEHICLE SUSPENSION SYSTEM

FIELD

Embodiments of the subject matter disclosed herein relate to suspension systems of vehicles, such as a suspension system of a rail vehicle.

BACKGROUND

Vehicles include suspension systems to absorb vibrations and mechanical shock during travel, as well as to distribute vehicle weight. The distribution of vehicle weight by suspension systems can significantly impact the propulsive force or tractive effort generated by a propulsion system of the vehicle and applied to the surface being traveled upon via wheels. For example, significant differences in the amount of vehicle weight carried by different wheel-axle sets in a vehicle can result in the wheel-axle sets having less payload weight applying significantly less tractive effort to a route surface than other wheel-axle sets having more payload weight. This can result in increased wear-and-tear on components of the propulsion system (e.g., traction motors that rotate the wheel-axle sets having less vehicle weight) and can result in slippage of wheels on the route surface.

BRIEF DESCRIPTION

In one embodiment, a locomotive suspension system includes a truck frame configured to be coupled with a locomotive body frame by one or more upper suspensions and a first motor suspension configured to be coupled with a first motor and the truck frame. The first motor is coupled with a first axle of the truck frame. The locomotive suspension system also includes a second motor suspension configured to be coupled with a second motor and the truck frame. The second motor is coupled with a second axle of the truck frame. The first and second motor suspensions are asymmetrically arranged on opposite sides of a bisecting plane of a truck wheelbase of the truck frame. The truck wheelbase extends from the first axle to the second axle along a length of the truck frame.

In one embodiment, a locomotive suspension system includes a truck frame configured to be coupled with a locomotive body frame and a first motor suspension configured to be coupled with a first motor and the truck frame. The first motor is connected with a first truck wheelset. The locomotive suspension system also includes a second motor suspension configured to be coupled with a second motor and the truck frame. The second motor is connected with a second truck wheelset that is separated from the first truck wheelset by a truck wheelbase of the truck. The first motor suspension is located inside the wheelbase of the truck between the first and second wheelsets while the second motor suspension is located outside of the truck wheelbase of the truck.

In one embodiment, a method includes coupling a truck frame with a locomotive body frame, coupling first and second truck wheelsets with the truck frame, and coupling a first motor suspension with a first motor and the truck frame. The first motor is connected with the first truck wheelset. The method also can include coupling a second motor suspension with a second motor and the truck frame. The second motor is connected with the second truck wheelset, which is separated from the first truck wheelset by a wheelbase of the truck. The first motor suspension is located inside the wheelbase of the truck between the first and second wheelsets while the second motor suspension is located outside of the wheelbase of the truck.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
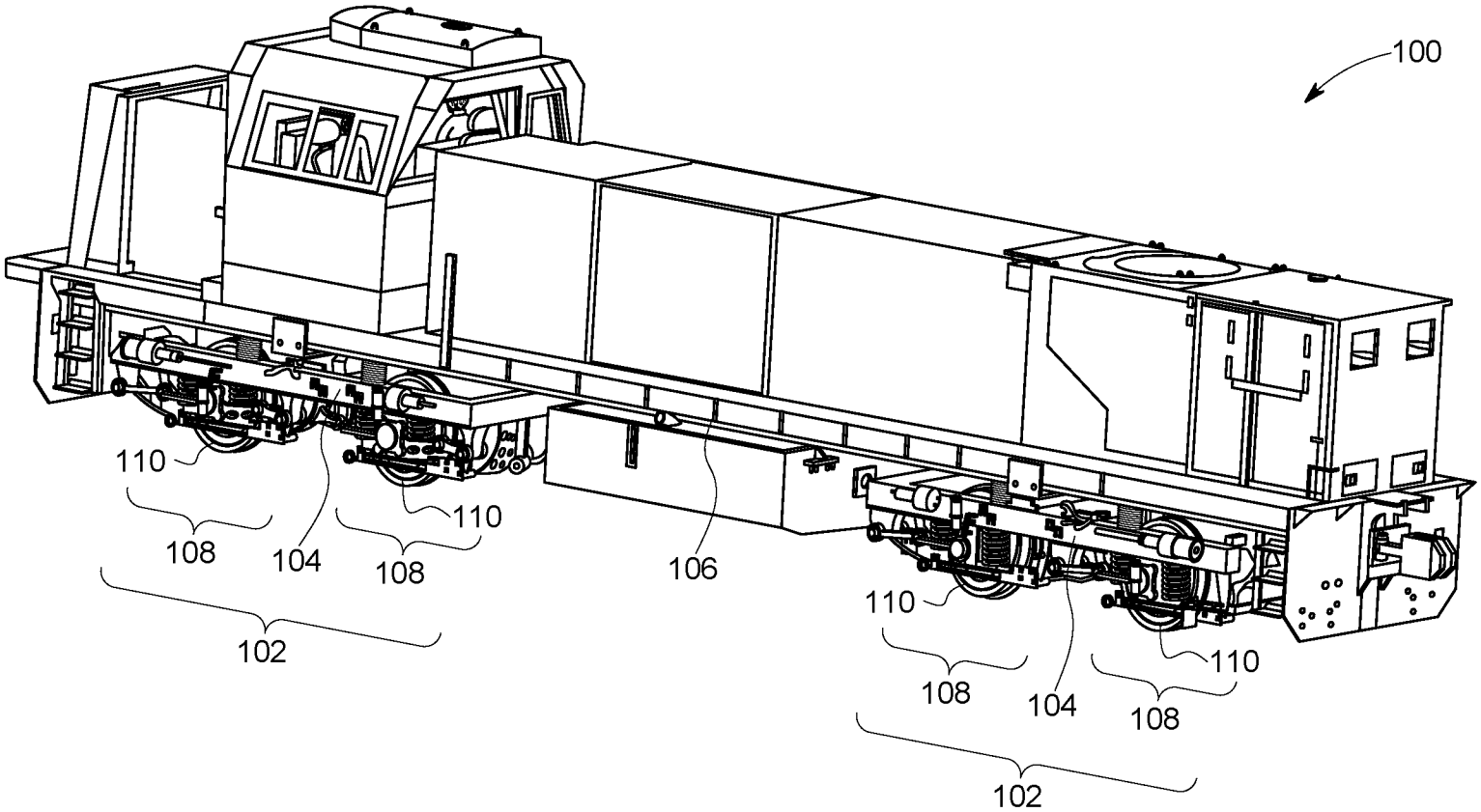
FIG. 1 illustrates one example of a vehicle.

One or more embodiments of the inventive subject matter described herein relate to suspension systems for vehicles, such as rail vehicles (e.g., locomotives). Rail vehicles can have trucks that include multiple wheel-axle sets that are individually rotated by different traction motors. Each wheel-axle set can include two or more wheels joined by an axle that is rotated by a traction motor.

In controlling the tractive effort imparted onto a route surface (e.g., the rail surface of a track), the tractive effort can be limited by the lightest axle within a truck. This lightest axle can transfer less tractive effort from the motor (or engine) to the route surface via connected wheels than other axles. The lightest axle refers to the wheel-axle set in the truck that carries less vehicle weight to the route surface than the other wheel-axle sets in the same truck. The vehicle weight includes the weight of the vehicle and the weight of cargo, payload, or the like, that is onboard the vehicle. Different wheel-axle sets in the same truck can carry different amounts of vehicle weight due to movement of the vehicle, as well as due to the arrangement of the suspension system of the truck. The amount or proportion of the vehicle weight that is carried to the route surface by an axle can be referred to as the axle weight of that axle.

Less tractive effort is generated or transferred to the route as the difference in axle weights increases for a vehicle or vehicle truck. Some known trucks in rail vehicles have two axles with motors coupled with the axles in a back-to-back arrangement. In this arrangement, each motor is coupled with a different axle such that both motors are between the axles and both motors are located within the wheelbase of the truck. The wheelbase is the distance from the center axis or axis of rotation of one axle to the center axis of the other axle in the truck. The suspension system for these types of trucks couples each of the motors to the truck frame in locations that are inside of the wheelbase. These suspensions of the motors can be referred to as symmetrical back-to-back motor suspensions of the truck.

The trucks also can be coupled with a vehicle chassis or vehicle body by a secondary suspension. Some known rail vehicles have this secondary suspension located in a center position on a transom of the truck (e.g., centered between the axles along a direction of travel of the truck and centered between opposite sides of the truck along a direction that is perpendicular to the direction of travel). This center location of the secondary suspension cannot evenly distribute the vehicle weight between the two axles if the gravity center of the truck does not lie in the same center of location, further increasing the difference in axle weights and reducing the tractive effort imparted to the route surface during traction.

One or more embodiments of the inventive subject matter described herein provide a suspension system for a vehicle having a different arrangement of the motors in a vehicle truck, and optionally a secondary suspension arrangement that is not located in a center of the truck body. As described herein, the suspension systems described herein can significantly reduce the uneven distribution of vehicle weight between the axles in a vehicle truck during traction, which can increase the tractive effort that is transferred to the route surface by the axles and wheels and can reduce the wear-and-tear on motors and wheels of the vehicle.

FIG. 1 illustrates one example of a vehicle 100. The vehicle 100 is shown as a rail vehicle (e.g., a locomotive), but alternatively may be an automobile, a semi-truck, a mining vehicle, another type of off-highway vehicle (e.g., a vehicle that is not designed for travel on public roadways and/or is not legally permitted for travel on public roadways), or another multi-axle vehicle. Although the description herein focuses on a locomotive as the vehicle 100, not all embodiments of the inventive subject matter are limited to locomotives or rail vehicles.

The vehicle 100 includes trucks 102 having a truck frame or chassis 104. The truck frames 104 have suspension systems (described below) that couple motors (not shown in FIG. 1) with the truck frames 104, and that couple the truck frames 104 with a chassis or body 106 of the vehicle 100. The motors are mechanically connected with wheel-axle sets 108 of the vehicle 100 and operate to rotate axles of the wheel-axle sets 108. The wheel-axle sets 108 optionally can be referred to as wheelsets or truck wheelsets. These axles are connected with wheels 110 of the vehicle 100 such that rotation of the axles also rotates the wheels 110 to propel the vehicle 100 along a route (e.g., a track, rail, road, or the like). The vehicle 100 can include a separate motor for each wheel-axle set 108 such that each axle can be individually and separately rotated by a different motor.

Figure 2:
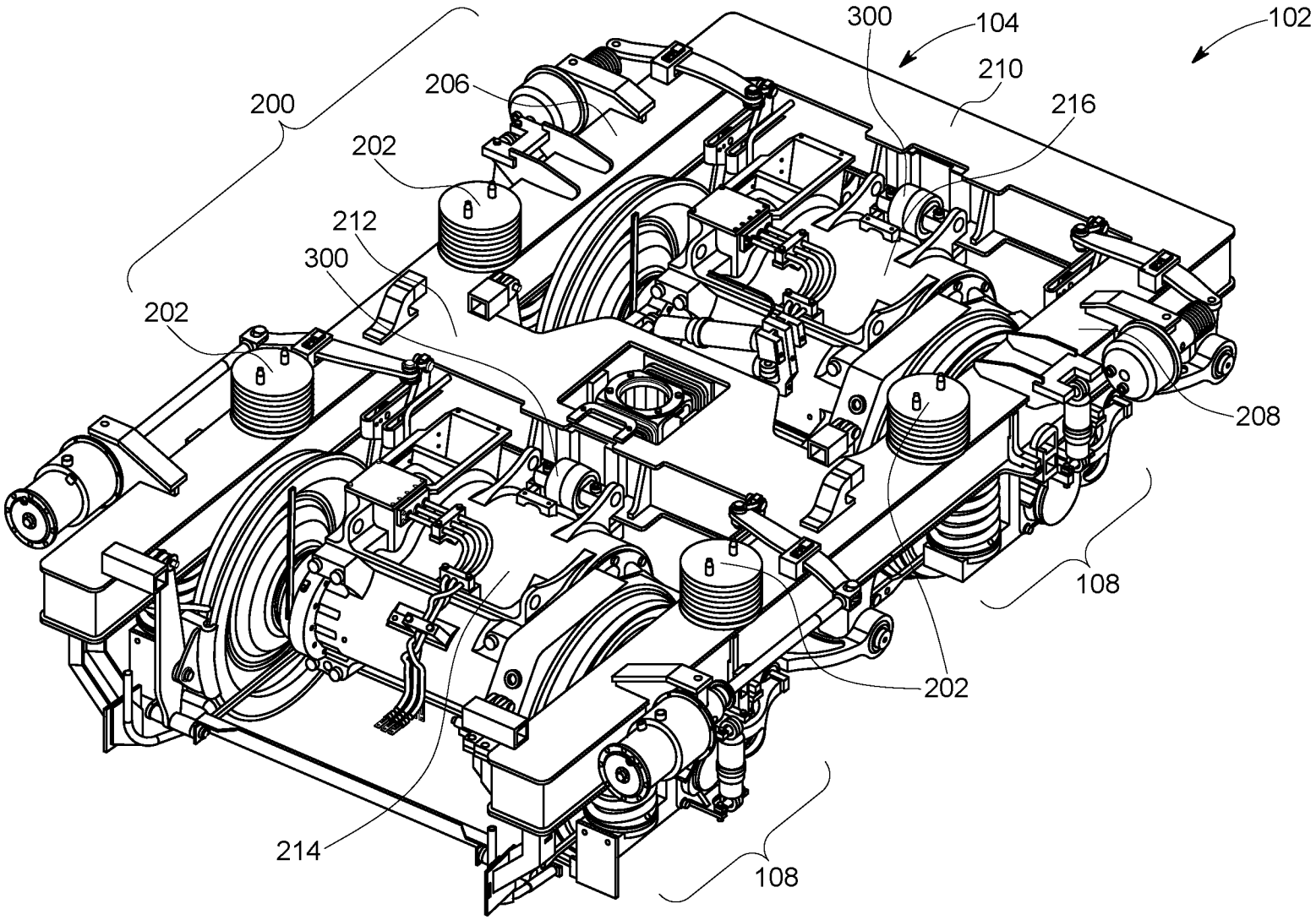
FIG. 2 illustrates a perspective view of one embodiment of a suspension system on a truck in the vehicle shown in FIG. 1.
Figure 3:
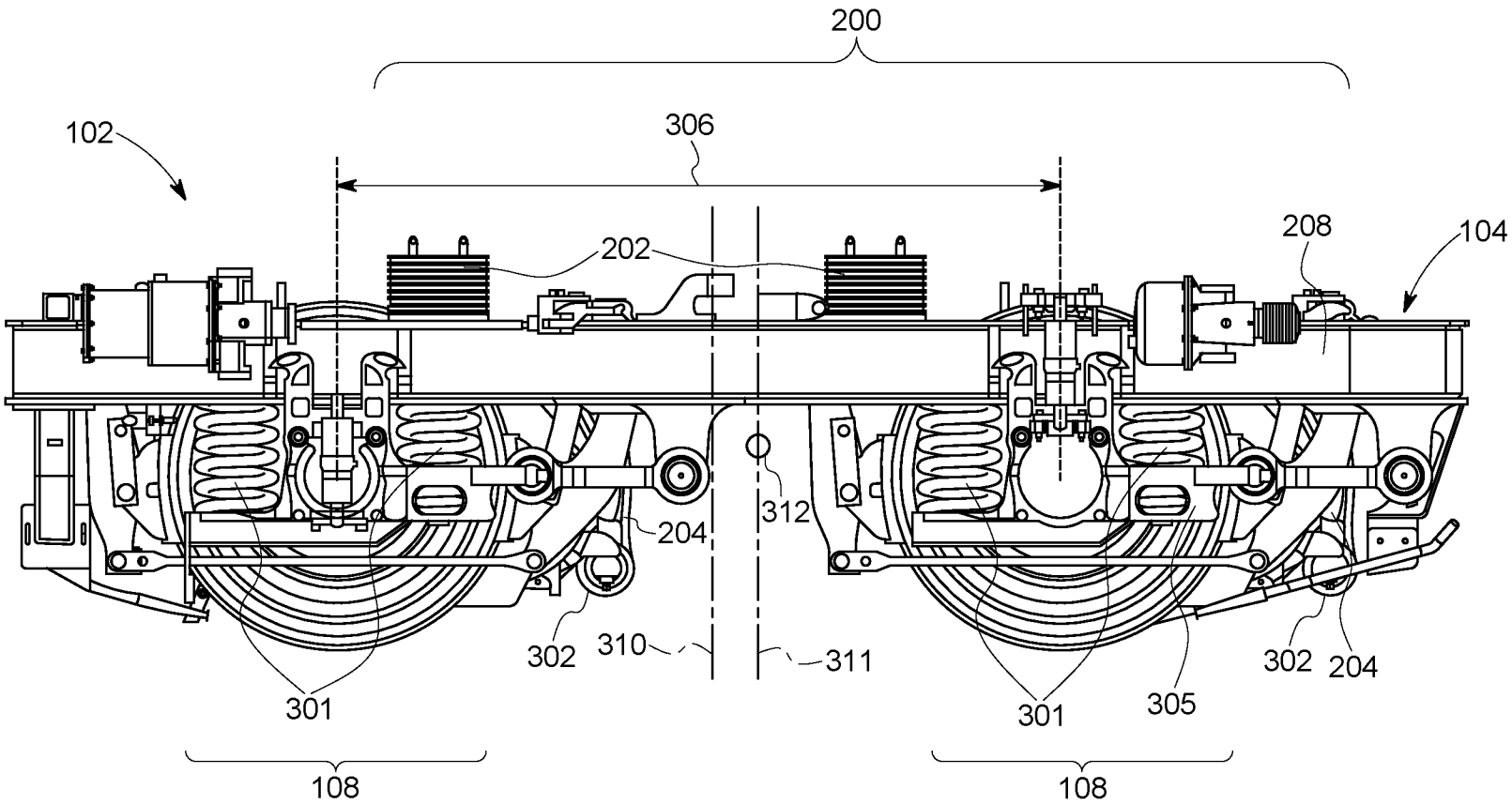
FIG. 3 illustrates a side view of the suspension system shown in FIG. 2.

FIG. 2 illustrates a perspective view of one embodiment of a suspension system 200 on one of the trucks 102 in the vehicle 100 shown in FIG. 1. FIG. 3 illustrates a side view of the suspension system 200 shown in FIG. 2. The suspension system 200 includes four upper suspensions 202, eight lower suspensions 301, and two motor suspensions 204 in one embodiment. Alternatively, the suspension system 200 may include fewer or more upper suspensions 202, lower suspensions 301, and/or motor suspensions 204. The suspensions 202, 204, 301 can provide elastic compliance to and absorb vibrations, mechanical shocks, and other movements that occur during movement of the vehicle 100.

The truck frame 104 is formed from elongated beams 206, 208 that are connected by a transom or crossbar bodies 210, 212. One transom body 210 is located at one end of the truck frame 104, while the other transom body 212 is located at a middle portion of the beams 206, 208 (e.g., midway between the opposite ends of the beams 206, 208). The transom body 210 can be referred to as an end transom or crossbar, while the transom body 212 can be referred to as a middle transom or crossbar.

The illustrated embodiment includes two upper suspensions 202 on each beam 206, 208, with each beam 206, 208 including one upper suspension 202 on each side of the middle transom body 212. The upper suspensions 202 can be the same or differ from each other (e.g., in terms of elasticity or resiliency to deformation). The upper suspensions 202 can be formed from resilient material that can be compressed upon application of a load and can return to an original shape following removal of the load. Optionally, the upper suspensions 202 can include springs that can be compressed upon application of a load and return to an original size following removal of the load.

Traction motors 214, 216 are coupled with axles of the wheel-axle sets 108 of the truck 102. As shown, the traction motors 214, 216 are in a tandem arrangement (described below). The motor suspensions 204 couple the motors 214, 216 with the transom bodies 210, 212. Each of the motor suspensions 204 can be an elongated body that is pivotally or rotatably coupled at an upper end 300 (shown in FIG. 2) with the transom bodies 210 or 212 and at an opposite lower end 302 (shown in FIG. 3) with a motor 214 or 216. This allows for the motors 214, 216 to hang from the transom bodies 210, 212 by the motor suspensions 204, and to not be supported by other structures from underneath or to the sides of the motors 214, 216. The motor suspensions 204 can be rigid bodies in one embodiment. For example, each motor suspension 204 can be a dog-bone suspension. Alternatively, the motor suspensions 204 can be a different type of suspension.

The lower suspensions 301 couple the truck frame 104 with journal boxes 305 that are coupled with the wheel-axle sets 108. The lower suspensions 301 can be springs or other bodies that can elastically deform upon application of sufficient weight. The lower suspensions 301 can return to their original size and/or shape upon removal of the weight. The lower suspensions 301 can include two lower suspensions 301 at each end of the respective axle. For example, the lower suspensions 301 of the truck 102 can include first and second lower suspensions 301 coupled with and extending between the truck frame 104 and a first journal box 305 (that is connected with one end of a first axle of the truck 102), third and fourth lower suspensions 301 coupled with and extending between the truck frame 104 and a second journal box 305 (that is connected with an opposite end of the first axle of the truck 102), fifth and sixth lower suspensions 301 coupled with and extending between the truck frame 104 and a third journal box 305 (that is connected with one end of a second axle of the truck 102), and seventh and eight lower suspensions 301 coupled with and extending between the truck frame 104 and a fourth journal box 305 (that is connected with the opposite end of the second axle of the truck 102).

A wheelbase 306 of the truck 102 extends from one axle to the other axle in the truck 102 along the length of the truck 102. The wheelbase 306 can be measured as a distance that extends from a center axis or axis of rotation of one axle to the center axis or axis of rotation of the other axle in the same truck 102, as shown in FIG. 3. A bisecting plane 310 of the wheelbase 306 is a two-dimensional plane located halfway between the center axes of rotation of the axles. For example, the bisecting plane 310 can be a plane that is perpendicular to the distance along which the wheelbase 306 is measured and that divides the wheelbase 306 in half. A gravity center plane 311 is a vertical plane which is perpendicular to the longitudinal center line of the truck 102 and intersects the gravity center or rotational center 312 of the truck 102. This rotational center 312 is the location about which the truck 102 rotates when different axle loads are borne by the axles and/or different tractive efforts are imparted on the route by the wheels 110 of different axles. Although the planes 310, 311 are shown as being different planes in FIG. 3, optionally, the bisecting plane 310 and the gravity center plane 311 can be in the same plane (e.g., the planes 310, 311 can be co-extensive with each other).

Figure 4:
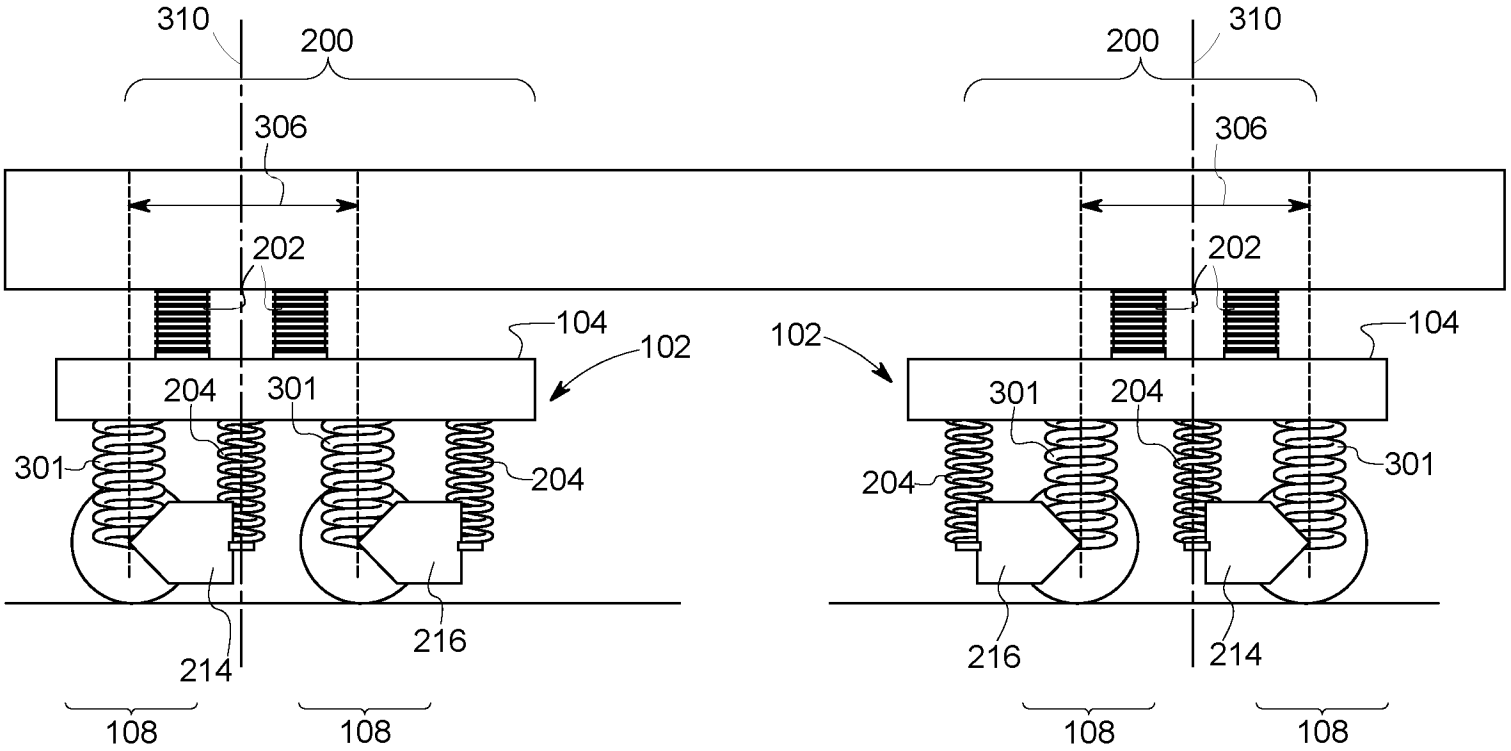
FIG. 4 schematically illustrates a side view of one embodiment of the suspension systems shown in FIGS. 2 and 3.
Figure 5:
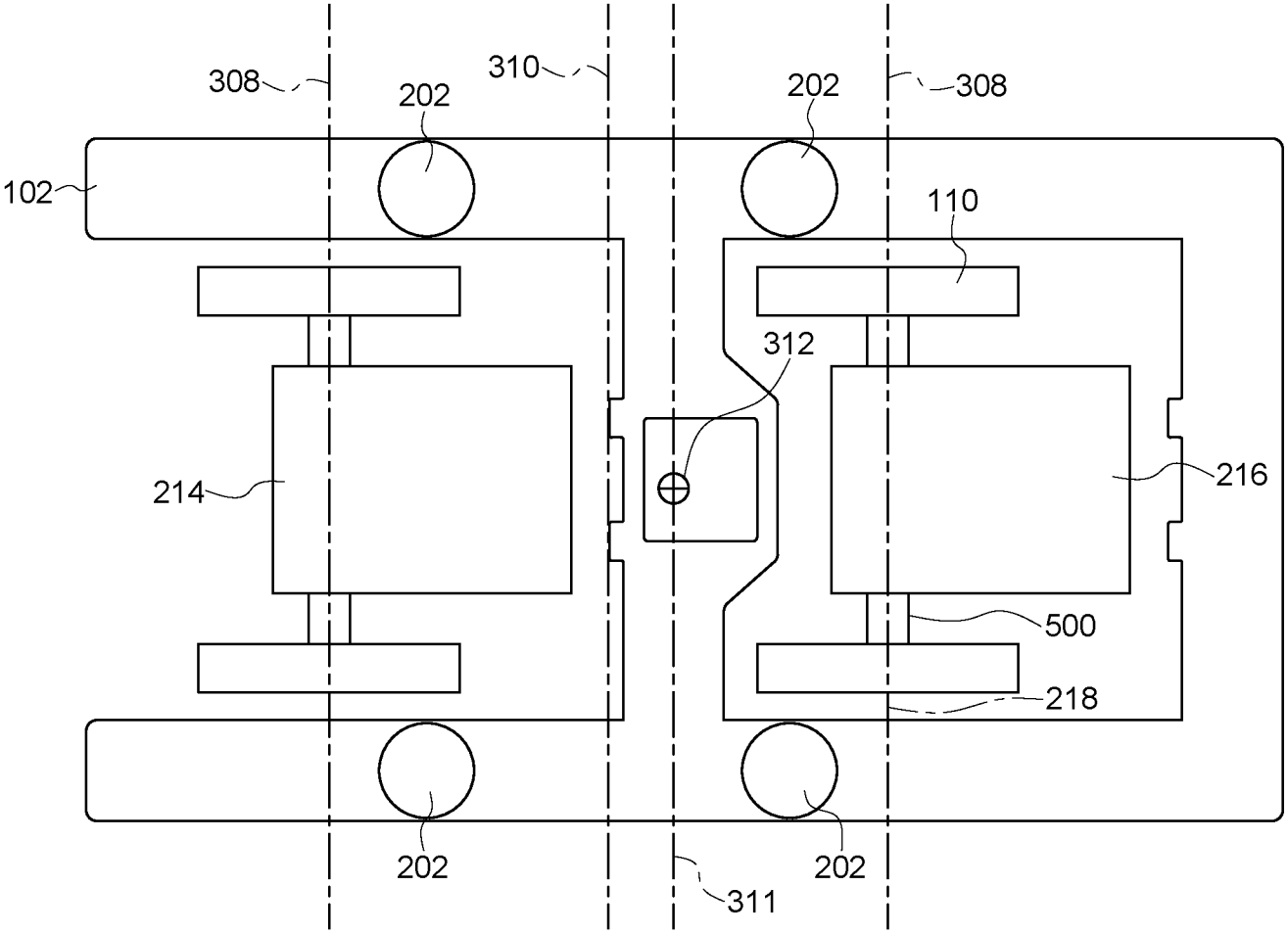
FIG. 5 schematically illustrates a top view of the suspension systems shown in FIG. 4.

FIG. 4 schematically illustrates a side view of one embodiment of two of the suspension systems 200 shown in FIGS. 2 and 3. FIG. 5 schematically illustrates a top view of the suspension systems 200 shown in FIG. 4. The upper suspensions 202 on each truck 102 are located or arranged on opposite sides of the gravity center plane 311. Two upper suspensions 202 are located on each side of the of the gravity center plane 311 and they can be equal or different distances (or approximately equal distances, such as by being within 5% of each other) from the plane 311 in the illustrated embodiment. Optionally, one set of the upper suspensions 202 on one side of plane 311 may be farther or closer to the plane 311 than the other set of upper suspensions 202 on the other side of plane 311.

Each set of the lower suspensions 301 that is coupled with the same wheel-axle set 108 is schematically shown in FIG. 4 as a single suspension. As a result, only two lower suspensions 301 are shown in FIG. 4 for the visible side of each truck 102, even though each side of the truck 102 may have a total of four lower suspensions 301 and each truck 102 may have a total of eight lower suspensions 301. For example, each wheel-axle set 108 may have four lower suspensions 301, with two lower suspensions 301 coupling the journal box to the frame for each wheel-axle set 108 on each opposite, lateral side of the truck 102.

The motors 214 and the motor suspensions 204 are asymmetrically arranged on opposite sides of the bisecting plane 310 in a tandem arrangement. Stated differently, the motor 214 on one side of the plane 310 is closer to the plane 310 than the motor 216 on the other side of the plane 310. The motor suspension 204 that connects the motor 214 with the truck frame 104 is located closer to the plane 310 than the motor suspension 204 that connects the motor 216 with the truck frame 104 such that the motor suspension 204 of the motor 214 is between the motor 214 and the plane 310, while the motor 216 is between the other motor suspension 204 and the plane 310. Each motor suspension 204 can be separated from the axis of rotation 308 of a corresponding axle 500 by an equal distance.

As shown, one motor suspension 204 is located within the wheelbase 306 of the truck 102 while the other motor suspension 204 is located outside of the wheelbase 306 of the truck 102. For example, the motor suspension 204 connected with the motor 214 is between the center axes 308 of the axles while the motor suspension 204 connected with the motor 216 is not between the center axes 308 of the axles.

The asymmetric arrangement or locations of the motors 214, 216 and motor suspensions 204 in the truck 102 can reduce the differential of axle loads carried by the axles when tractive effort is generated by the motors 214, 216. Other known suspension systems have a symmetric arrangement of the motors 214, 216 and lower suspensions such that the motors are between the motor suspensions within the wheelbase, each motor is between the corresponding lower suspension and the bisecting plane of the truck, and both lower suspensions are located within the wheelbase. These symmetric arrangements also can be referred to as back-to-back arrangements, as the back sides of the motors (the parts of the motors that couple with the lower suspensions) face each other.

The asymmetric arrangement of the suspension system 200 reduces the axle weight differential and resulting tractive effort loss relative to the symmetric arrangement of a suspension system. The symmetric arrangement of a suspension system can result in the axle load borne by the leading axle in a truck (along the direction of travel) to be reduced by 30% or more, while the trailing axle in the same truck is increased by approximately 30% (e.g., 27% or more). The difference of the axle loads between the leading axle and the trailing axle of the same truck can be as much as 60%. This can significantly decrease the tractive effort imparted on the route by the wheels coupled with the leading axle during traction of a truck control. Conversely, the asymmetric arrangement of the suspension system 200 can result in the axle load borne by each of the axles in the same truck 102 being reduced by less than 10%, while the axle load borne by each of the axles in another truck 102 in the same vehicle 110 being increased by less than 10%. The difference of the axle loads between the leading axle and the trailing axle of the same truck can be reduced to almost zero. This can significantly increase the tractive effort imparted on the route by the wheels 110 of the two trucks 102 relative to the symmetric arrangement.

Figure 6:
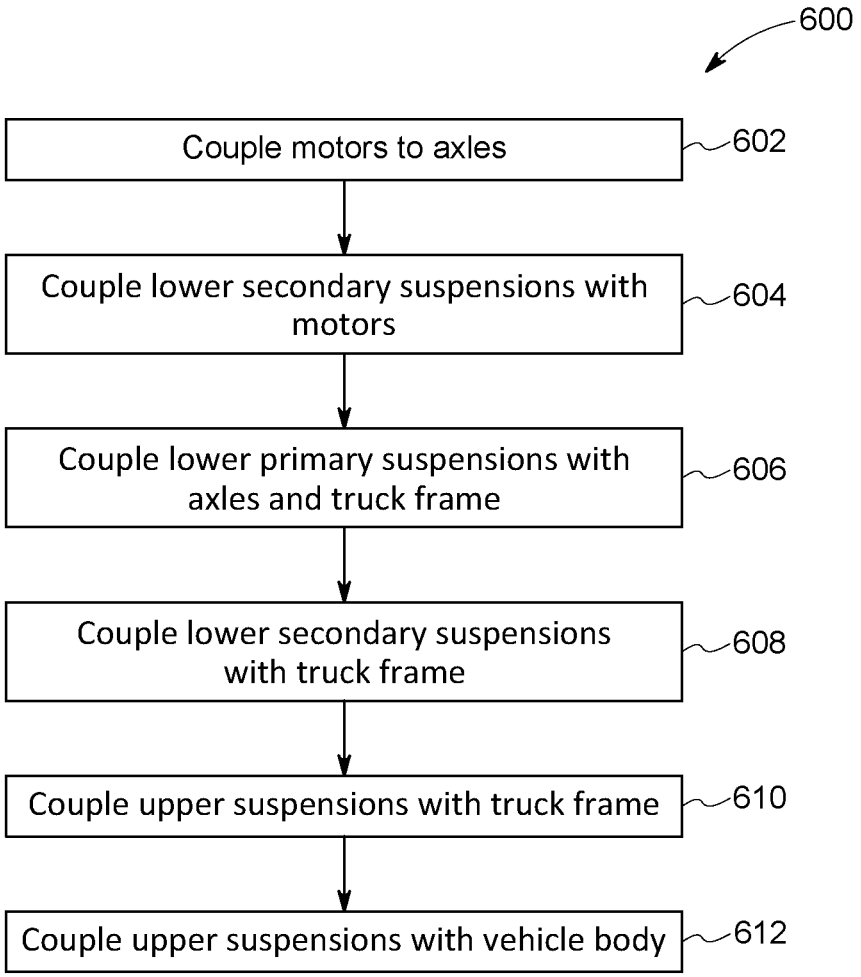
FIG. 6 illustrates a flowchart of one embodiment of a method for creating a suspension system in an asymmetric arrangement.

FIG. 6 illustrates a flowchart of one embodiment of a method 600 for creating a suspension system in a tandem arrangement. The method 600 can represent the operations performed to create one or more embodiments of the suspension systems 200 described herein. At 602, motors are coupled with axles of a vehicle. For example, the motors 214, 216 for each truck 102 can be connected with axles of wheel-axle sets 108. At 604, motor suspensions are coupled with the motors. The motor suspensions 204 can be connected with the motors 214, 216 at one end of each of the motor suspensions 204.

At 606, lower suspensions are coupled with axles of the wheel-axle sets and with frames of the trucks. For example, one end of each of the lower suspensions 301 can be connected with a journal box 305 of a wheel-axle set 108. The other, opposite end of the same lower suspension 301 can be connected with the truck frame 104. At 608, the motor suspensions are coupled with the truck frame. The end of each of the motor suspensions 204 that is opposite the end that is coupled with the motor 214 or 216 can be connected with the truck frame 104. For example, the lower ends of the motor suspensions 204 can be the ends closer to the route surface and can be connected with the motors 214, 216 (at 604). The opposite upper ends of the motor suspensions 204 can be connected with the truck frame 104 so that the motors 214, 216 are hanging from the truck frame 104.

At 610, upper suspensions are coupled with the truck frame. For example, the upper suspensions 202 can be coupled with the upper part or surface of the truck frame. The upper suspensions can be arranged on the truck such that the upper suspensions are on each side of the gravity center plane 311 of the truck frame 104. At 612, the upper suspensions are coupled with a frame, body, or chassis of a vehicle. For example, connecting the truck 102 with the frame of the vehicle 110 can include connecting the upper suspensions 202 with the vehicle frame or vehicle body 106.

In one embodiment, a locomotive suspension system includes a truck frame configured to be coupled with a locomotive body frame by one or more upper suspensions and a first motor suspension configured to be coupled with a first motor and the truck frame. The first motor is coupled with a first axle of the truck frame. The locomotive suspension system also includes a second motor suspension configured to be coupled with a second motor and the truck frame. The second motor is coupled with a second axle of the truck frame. The first and second motor suspensions are asymmetrically arranged on opposite sides of a bisecting plane of a truck wheelbase of the truck frame. The truck wheelbase extends from the first axle to the second axle along a length of the truck frame.

Optionally, the locomotive suspension system also can include a first lower suspension configured to couple the first axle with the truck frame and a second lower suspension configured to couple the second axle with the truck frame. The first lower suspension can include at least one lower suspension at each of opposite ends of the first axle. The second lower suspension can include at least one lower suspension at each of opposite ends of the second axle.

The first and second motor suspensions can be asymmetrically arranged on the opposite sides of the bisecting plane of the truck wheelbase such that the first motor suspension is located between the first motor and the bisecting plane and the second motor is located between the bisecting plane and the second motor suspension.

Optionally, the locomotive suspension system also includes a first upper suspension configured to couple the truck frame with the locomotive body frame and a second upper suspension configured to couple the truck frame with the locomotive body frame. The first upper suspension and the second upper suspension are located on opposite sides of the gravity center plane. The gravity center plane can intersect a gravity center or a rotational center of the truck in one embodiment.

The first motor suspension can be separated from a center of a first axis of the truck and the second motor suspension can be separated from a center of a second axis of the truck by equal distances. Optionally, first motor suspension is located closer to the bisecting plane than the second motor suspension. The first motor suspension can be located within the truck wheelbase while the second motor suspension is located outside of the truck wheelbase.

In one embodiment, a locomotive suspension system includes a truck frame configured to be coupled with a locomotive body frame and a first motor suspension configured to be coupled with a first motor and the truck frame. The first motor is connected with a first truck wheelset. The locomotive suspension system also includes a second motor suspension configured to be coupled with a second motor and the truck frame. The second motor is connected with a second truck wheelset that is separated from the first truck wheelset by a truck wheelbase of the truck. The first motor suspension is located inside the wheelbase of the truck between the first and second wheelsets while the second motor suspension is located outside of the truck wheelbase of the truck.

Optionally, the first and second motor suspensions are asymmetrically arranged on opposite sides of a bisecting plane of the truck wheelbase. The first motor suspension can be located between the first motor and the second motor and the second motor can be located between the first motor suspension and the second lower suspension. The locomotive suspension system also can include one or more upper suspensions on each side of a rotational center of the truck frame.

The first motor suspension can be separated from a center of a first axis of the first truck wheelset and the second motor suspension can be separated from a center of a second axis of the second truck wheelset by equal distances. The first motor suspension can be located closer to a rotational center of the truck frame than the second motor suspension.

In one embodiment, a method includes coupling a truck frame with a locomotive body frame, coupling first and second truck wheelsets with the truck frame, and coupling a first motor suspension with a first motor and the truck frame. The first motor is connected with the first truck wheelset. The method also can include coupling a second motor suspension with a second motor and the truck frame. The second motor is connected with the second truck wheelset, which is separated from the first truck wheelset by a wheelbase of the truck. The first motor suspension is located inside the wheelbase of the truck between the first and second wheelsets while the second motor suspension is located outside of the wheelbase of the truck.

Optionally, the first motor suspension is coupled with the first motor and the second motor suspension is coupled with the second motor such that the first and second motor suspensions are asymmetrically arranged on opposite sides of a bisecting plane of the truck wheelbase. The first motor suspension can be coupled with the first motor and the truck frame such that the first motor suspension is located between the first motor and the second motor. The second motor suspension can be coupled with the second motor and the truck frame such that the second motor is located between the first motor suspension and the second lower suspension.

Coupling the truck frame with the locomotive body frame can include connecting the truck frame with the locomotive body frame using two of the upper suspensions on each side of a rotational center of the truck frame. The first wheelset can be coupled to the truck frame by the first lower primary suspension set, which includes one or more suspensions on each side of the wheelset. The second wheelset can be coupled to the truck frame by the second lower primary suspension set which includes one or more suspensions on each side of the wheelset. The first and second lower suspensions can be coupled with the truck frame such that the first lower suspension is separated from a center of a first axis of the truck and the second lower suspension is separated from a center of a second axis of the truck by equal distances. The first and second motor suspensions can be coupled with the truck frame such that the first motor suspension is located closer to a bisecting plane of the truck wheelbase than the second motor suspension.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all the subject matter of the above description or shown in the accompanying drawings shall be interpreted merely as examples illustrating the inventive concept herein and shall not be construed as limiting the inventive subject matter.

As used herein, a structure, limitation, or element that is "configured to" perform a task or operation is particularly structurally formed, constructed, programmed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, programming of the structure or element to perform the corresponding task or operation in a manner that is different from an "off-the-shelf" structure or element that is not programmed to perform the task or operation, and/or denotes structural requirements of any structure, limitation, or element that is described as being "configured to" perform the task or operation.

What is claimed is:

1. A vehicle suspension system comprising:

a truck frame including two elongated beams and at least two transom bodies that extend between and mechanically connect the two elongated beams, wherein the at least two transom bodies include a middle transom body located midway along a length of the truck frame, the truck frame mechanically coupled to no more or less than a first wheelset and a second wheelset located on opposite sides of the middle transom body;

a first set of upper suspensions and a second set of upper suspensions configured to couple the truck frame with a vehicle body frame;

a first motor suspension configured to be coupled with a first motor that is coupled with an axle of the first wheelset, the first motor suspension located between the first set of the upper suspensions and the second set of the upper suspensions along the length of the truck frame; and a second motor suspension configured to be coupled with a second motor that is coupled with an axle of the second wheelset, the second set of the upper suspensions located between the first motor suspension and the second motor suspension along the length of the truck frame, wherein the first and second motor suspensions are asymmetrically arranged on opposite sides of a bisecting plane of a truck wheelbase of the truck frame, and wherein the first and second sets of the upper suspensions are asymmetrically arranged on the opposite sides of the bisecting plane of the truck wheelbase, the truck wheelbase extending from the axle of the first wheel set to the axle of the second wheel set along the length of the truck frame.

2. The vehicle suspension system of claim 1, further comprising:

a first lower suspension configured to couple the axle of the first wheelset with the truck frame; and a second lower suspension configured to couple the axle of the second wheelset with the truck frame.

3. The vehicle suspension system of claim 2, wherein the first lower suspension includes at least one lower suspension at each of opposite ends of the axle of the first wheelset, and the second lower suspension includes at least one lower suspension at each of opposite ends of the axle of the second wheelset.

4. The vehicle suspension system of claim 1, wherein the first and second motor suspensions are asymmetrically arranged on the opposite sides of the bisecting plane of the truck wheelbase such that the first motor suspension is located between the first motor and the bisecting plane and the second motor is located between the bisecting plane and the second motor suspension.

5. The vehicle suspension system of claim 1, wherein the first set of the upper suspensions and the second set of the upper suspensions are located on opposite sides of a gravity center plane of the vehicle suspension system, the gravity center plane intersecting a rotational center of the vehicle suspension system, the second set of the upper suspensions disposed closer to the gravity center plane than a proximity of the first set of the upper suspensions to the gravity center plane.

6. The vehicle suspension system of claim 1, wherein the first motor suspension is separated from an axis of rotation of the axle of the first wheelset and the second motor suspension is separated from an axis of rotation of the axle of the second wheelset by equal distances.

7. The vehicle suspension system of claim 1, wherein the first motor suspension is located closer to the bisecting plane than the second motor suspension.

8. The vehicle suspension system of claim 1, wherein the first motor suspension is located within the truck wheelbase while the second motor suspension is located outside of the truck wheelbase.

9. A vehicle suspension system comprising:

a truck frame mechanically coupled to no more or less than a first wheelset and a second wheelset, the truck frame including a middle transom body located midway along a length of the truck frame, the first wheelset and the second wheelset disposed on opposite sides of the middle transom body;

a first set of upper suspensions and a second set of upper suspensions configured to couple the truck frame with a vehicle body frame;

a first motor suspension configured to be coupled with a first motor that is coupled with an axle of the first wheelset, the first motor suspension located between the first set of the upper suspensions and the second set of the upper suspensions along the length of the truck frame; and a second motor suspension configured to be coupled with a second motor that is coupled with an axle of the second wheelset, the second set of the upper suspensions located between the first motor suspension and the second motor suspension along the length of the truck frame, wherein the first motor suspension is located inside a truck wheelbase defined between the respective axles of the first and second wheel sets while the second motor suspension is located outside of the truck wheelbase, and wherein the first and second sets of the upper suspensions are asymmetrically arranged on opposite sides of a bisecting plane of the truck wheelbase.

10. The vehicle suspension system of claim 9, wherein the first and second motor suspensions are asymmetrically arranged on opposite sides of the bisecting plane of the truck wheelbase such that the first motor suspension is located closer to the bisecting plane than a proximity of the second motor suspension to the bisecting plane.

11. The vehicle suspension system of claim 9, wherein the first motor suspension is configured to be located between the first motor and the second motor, and the second motor is configured to be located between the first motor suspension and the second motor suspension.

12. The vehicle suspension system of claim 9, wherein the first set of the upper suspensions are located on opposite sides of a rotational center of the vehicle suspension system, and both the first set and the second set are spaced apart from the middle transom body.

13. A method comprising:

coupling a truck frame with a vehicle body frame via a first set of upper suspensions and a second set of upper suspensions, the truck frame including a middle transom body located midway along a length of the truck frame;

coupling no more or less than a first wheelset and a second wheelset with the truck frame such that the first and second wheelsets are disposed on opposite sides of the middle transom body;

coupling a first motor suspension with a first motor that is coupled with an axle of the first wheelset, the first motor suspension coupled with the first motor such that the first motor suspension is located between the first set of the upper suspensions and the second set of the upper suspensions along the length of the truck frame; and coupling a second motor suspension with a second motor that is coupled with an axle of the second wheelset, the second motor suspension coupled with the second motor such that the second set of the upper suspensions is located between the first motor suspension and the second motor suspension along the length of the truck frame, wherein the first motor suspension is located inside a truck wheelbase defined between the respective axles of the first and second wheel sets while the second motor suspension is located outside of the truck wheelbase, and wherein the first and second sets of the upper suspensions are asymmetrically arranged on opposite sides of a bisecting plane of the truck wheelbase.

14. The method of claim 13, wherein the first motor suspension is coupled with the first motor and the second motor suspension is coupled with the second motor such that the first and second motor suspensions are asymmetrically arranged on opposite sides of the bisecting plane of the truck wheelbase.

15. The method of claim 13, wherein the first motor suspension is located between the first motor and the second motor, and the second motor is located between the first motor suspension and the second motor suspension.

16. The method of claim 13, wherein the first motor suspension is located closer to the bisecting plane of the truck wheelbase than a proximity of the second motor suspension to the bisecting plane.

17. The vehicle suspension system of claim 1, wherein the first motor suspension is coupled to the middle transom body and the second motor suspension is coupled to an end transom body of the at least two transom bodies.

18. The vehicle suspension system of claim 1, wherein the at least two transom bodies include the middle transom body and an end transom body that is disposed at a first end of the truck frame, wherein the truck frame lacks a transom body at a second end of the truck frame opposite the first end.

19. The vehicle suspension system of claim 1, wherein the first set of the upper suspensions and the second set of the upper suspensions are located on opposite sides of the middle transom body and both the first set and the second set are spaced apart from the middle transom body.

20. The vehicle suspension system of claim 1, wherein the first set of the upper suspensions comprises a first upper suspension mounted on a first elongated beam of the two elongated beams and a second upper suspension mounted on a second elongated beam of the two elongated beams, and the second set of the upper suspensions comprises a third upper suspension mounted on the first elongated beam and a fourth upper suspension mounted on the second elongated beam.

* * * * *